United States Patent [19]

Costa et al.

[11] Patent Number: 4,689,617

[45] Date of Patent: Aug. 25, 1987

[54] CONCENTRIC VIA PLASMA PANEL

[75] Inventors: Michael J. Costa; Jesse B. Shapiro, both of Poughkeepsie, N.Y.

[73] Assignee: International Business Machines Corporation, Armonk, N.Y.

[21] Appl. No.: 729,004

[22] Filed: Apr. 30, 1985

[51] Int. Cl.[4] ..... G09G 3/28

[52] U.S. Cl. ..... 340/771; 340/774; 340/773; 340/703; 315/169.4

[58] Field of Search ..... 340/781, 784, 794, 701, 340/703, 802, 771, 773, 774; 315/169.1, 169.4

[56] References Cited

U.S. PATENT DOCUMENTS

| | | | |
|---|---|---|---|
| 3,673,451 | 6/1972 | Jackett | 315/169.4 |
| 3,704,386 | 11/1972 | Cola | 315/169.4 |
| 3,826,949 | 7/1974 | Nakamura et al. | 340/802 |
| 3,873,870 | 3/1975 | Fukushima et al. | 340/703 |
| 3,956,667 | 5/1976 | Veith | 340/703 |
| 4,106,009 | 8/1978 | Dick | 340/774 |
| 4,176,297 | 11/1979 | Thistle et al. | 315/169.4 |

OTHER PUBLICATIONS

Sobel, "Gas-Discharge Displays: The State of the Art", IEEE Trans. on Electron Devices, vol. ed-24, No. 7, Jul. 1977, pp. 835-847.

*Primary Examiner*—Gerald L. Brigance

*Attorney, Agent, or Firm*—Joseph J. Connerton

[57] ABSTRACT

A one sided a.c. plasma panel comprises a glass substrate encapsulated within a pair of glass plates dividing the panel into two interconnected chambers. One set of conductor arrays originate within the rear aperture are are conducted through display vias to circular electrodes in the front aperture. The second set of electrodes comprise annular rings which are concentric and coplanar with the circular electrodes. This configuration limits discharge spread on the display surface, permitting increased resolution without crosstalk. Multicolor capability is provided by the combination of ultraviolet sensitive phosphors on the inner surface of the front faceplate and an ultraviolet emitting gas within the plasma panel.

9 Claims, 4 Drawing Figures

SECTION A-A

CONCENTRIC VIA PLASMA PANEL

BACKGROUND OF THE INVENTION

In conventional a.c. plasma display technology, orthogonal conductor arrays are formed on a pair of glass plates and the conductor arrays, when fabricated, are disposed substantially orthogonal to each other and overcoated with a dielectric layer, the intersection of a pair of conductors defining a display site or cell. When write signals are selectively applied across orthogonal conductor sets of the conventional a.c. plasma display, the fields at addressed cells produce a localized discharge in the area between conductors providing a visible display. The display is maintained by a lower amplitude sustain signal which combines with the wall charge potential to continuously discharge the selected cells.

Each discharge tends to spread beyond the edges of the conductors into the region between lines. Discharge spreading results from coupling between confronting conductors, beyond the immediate area of congruency, where the electric field remains strong. Minimum spacing between lines, i.e., display resolution, is determined, among other factors, by the requirement to keep the plasma of adjacent cells separated. Panel gap, dielectric thickness and line width are other factors which contribute to the minimum allowable line spacing. These indirect means of controlling discharge spread stem from the "unbounded" character of the electric fields produced by two flat, orthogonal conductors, and discharge spreading diminishes with distance from the origin.

While the various technology problems relative to conventional twin substrate a.c. plasma panels have been resolved, the process of manufacturing such displays is complex and of substantial duration, such that the cost of such displays remains relatively high. For a more thorough description of plasma panel fabrication, reference is made to U.S. Pat. No. 3,837,734 "Gas Panel Fabrication", assigned to the assignee of the instant invention.

An alternative form of an a.c. plasma display is a single sided panel. One sided or single substrate panels are known in the art and have been described in the literature. Such panels generally entail a single substrate or glass plate on which various layers of conductors and dielectrics are formed and suitably insulated from one another. Similarly, in single substrate a.c. plasma panels, the fields resulting from coupling between orthogonal conductors outside cell boundaries are strong enough to produce a plasma which extends beyond the mutual overlap boundaries of the conductors. Poor plasma confinement within such displays necessitates wider spacing between cells and imposes a limitation on the resolution heretofore attainable with previous single substrate plasma panel designs. Finally, when one sided plasma panel technology is extended to color, the tendency of the positive ions produced during discharge to bombard and destroy or degrade the phosphors has limited the development of a multi-color capability in one sided panels. It is toward the solution of these problems in a single sided plasma panel that the present invention is directed.

SUMMARY OF THE INVENTION

A single substrate plasma display structure is described in which the plasma spread associated with a selected cell is limited by a boundary defined by one of two cell electrodes. The panel consists of a central substrate enclosed by a pair of glass plates that comprise a gas envelope. On the front of the substrate are vertical or Y conductors made up of annular rings connected by line segments. A circular via, passing through the substrate from below, terminates in a circular electrode which is concentric and coplanar with each ring. On the rear of the substrate horizontal or X conductors buss the vias together in rows. The busses extend to transfer vias located on opposite ends of each horizontal line where horizontal conductivity is transferred to thin film conductors on the front surface of the display which passes outside the envelope.

The terminations of the display vias and coplanar concentric rings comprise the field generating electrodes for the X-Y matrix. A layer of dielectric glass overcoated with MgO covers the electrodes. Vent vias in the four corners permit processing of both chambers with one exhaust tubulation and provide reference points for plate alignment during panel fabrication.

The technology of a one sided monochrome panel can be extended to color by use of a faceplate with ultraviolet sensitive phosphors deposited on the inside surface of the front glass plate confining the cells, and substituting a gas mixture with ultra-violet emission capability and low visible intensity. By separating the phosphor from the discharge cells in this manner, phosphor degradation by position ion bombardment is prevented, and the discharge surface is protected from contamination by phosphor particulates.

Accordingly, a primary object of the present invention is to provide an improved high resolution single sided a.c. plasma display panel.

Another object of the present invention is to provide an improved high resolution single sided a.c. plasma display panel with multicolor capability.

BRIEF DESCRIPTION OF THE DRAWINGS

FIG. 3(*b*) is a section view taken along the line A—A of FIG. 3(*a*).

DESCRIPTION OF A PREFERRED EMBODIMENT

As previously described, one of the basic problems in single substrate a.c. panels is charge confinement during discharge, since the plasma discharge tends to extend beyond the mutual overlap boundaries of the conductors into the regions between conductors. This crosstalk problem is addressed in the instant invention by a combination of cell geometry and coplanar conductor arrays. With respect to geometry, one of the cell electrodes is an annular thin film ring which confines the discharge within the boundary defined by the ring. The second feature is that the rear electrodes are brought to the front by use of vias and are centered in and made coplanar with the ring electrodes.

Figure 1:
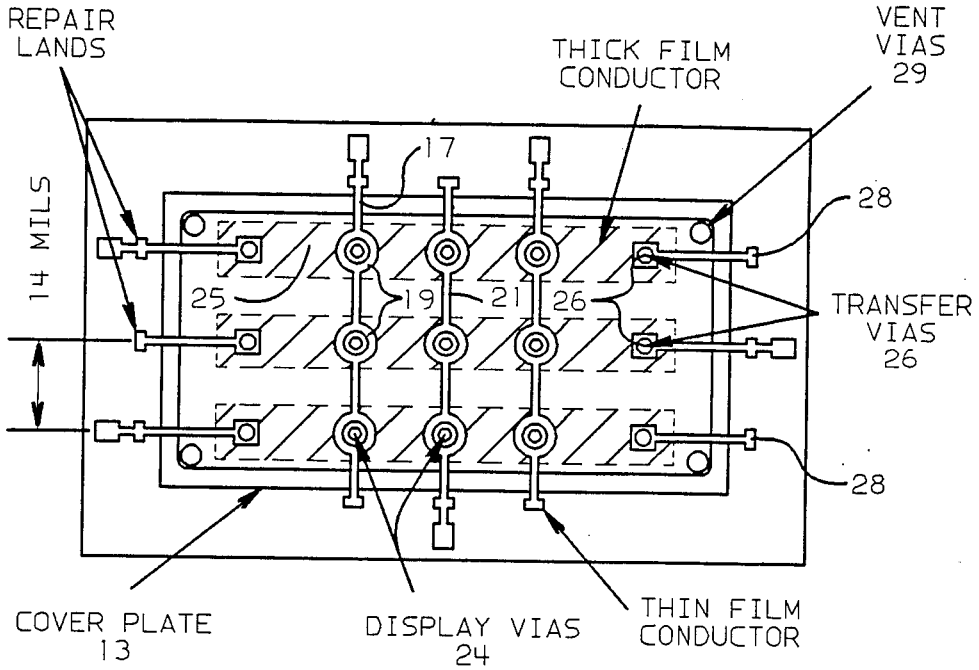
FIG. 1 is a plan view of a preferred embodiment of the instant invention.
Figure 2:
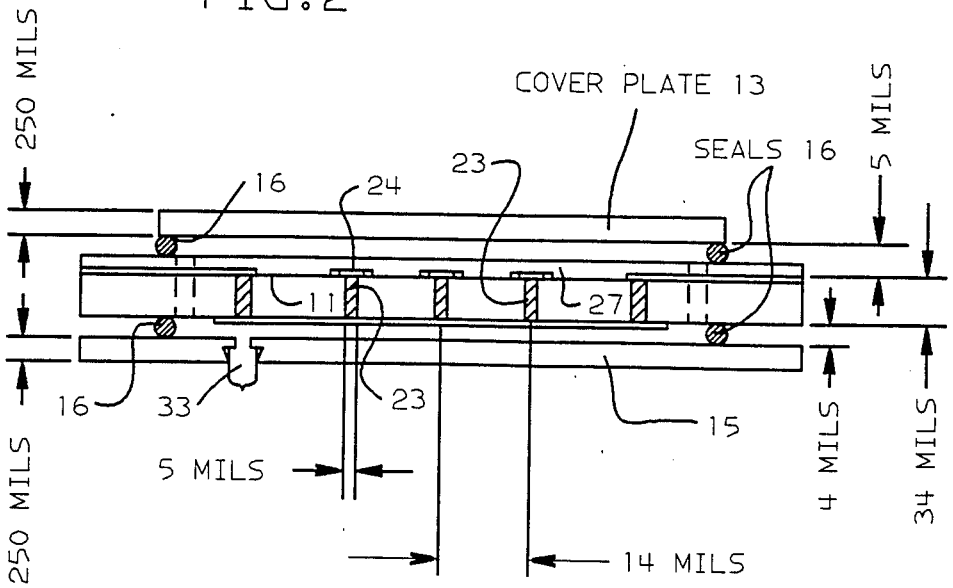
FIG. 2 is a section front view of the plan view of FIG. 1.

Referring now to the drawings and more particularly to FIGS. 1 and 2 thereof, a single sided display panel consists of a central substrate 11 enclosed by glass plates 13, 15 which, when sealed by seal 16 comprise the gas envelope which is filled with an ionizable gas. On the front of substrate 11 are vertical conductors 17 comprising thin film annular rings 19 interconnected by line segments 21. The circular electrodes comprising the terminations of vias 23, are thick film which pass through the substrate 11 from below, and are concentric with annular rings 19. On the opposite side of the substrate, horizontal conductors, shown as hatched areas 25 in FIG. 1, buss the vias 23 together in rows. Thick film metallurgy is used for the busses, which extend to tranfer vias 26 located on opposite ends of horizontal busses 25 where horizontal conductivity is transferred to thin film conductors 28 on the front surface of the display panel for passage outside the envelope beneath seal 16.

The via termination electrodes and associated coplanar concentric rings are the field generating electrodes for the X-Y matrix. A layer of dielectric glass having a nominal thickness of one mil., overcoated with magnesium oxide, is shown in FIG. 2 as a single composite layer 27 overcoating the electrodes. The thickness of the dielectric relative to that of the conductors is significant in reducing discharge spread. Accordingly, the dielectric layer has a nominal thickness of 1 mil., while the electrodes, as previously described, are thin film conductors. The magnesium oxide is a refractory material which protects the dielectric surface during discharge, while its secondary emissive characteristic permits lower operating voltages. Alternatively, the electrode area alone could be covered. Vent vias 29 in the four corners of the panel assembly interconnect the front and rear chambers to permit processing of both chambers with one exhaust tubulation 33 (FIG. 2) located at the rear of the assembly while also serving for plate alignment during fabrication.

Figure 3A:
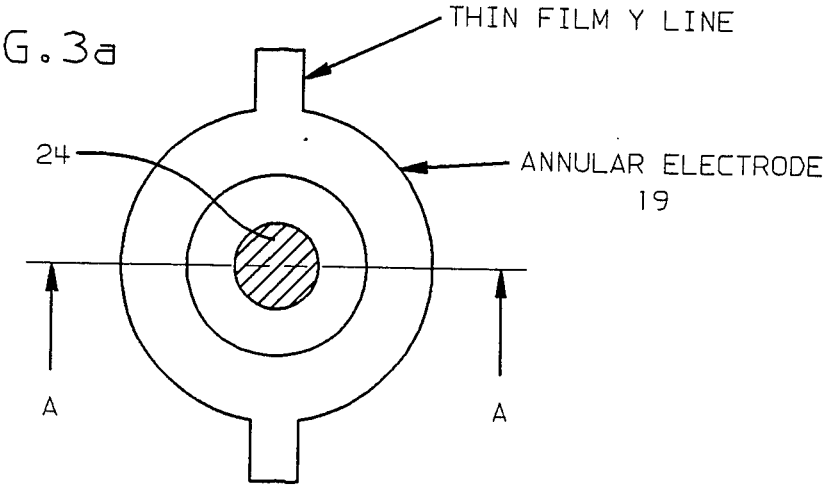
FIG. 3(*a*) is a detailed enlargement of an annular electrode structure.
Figure 3B:
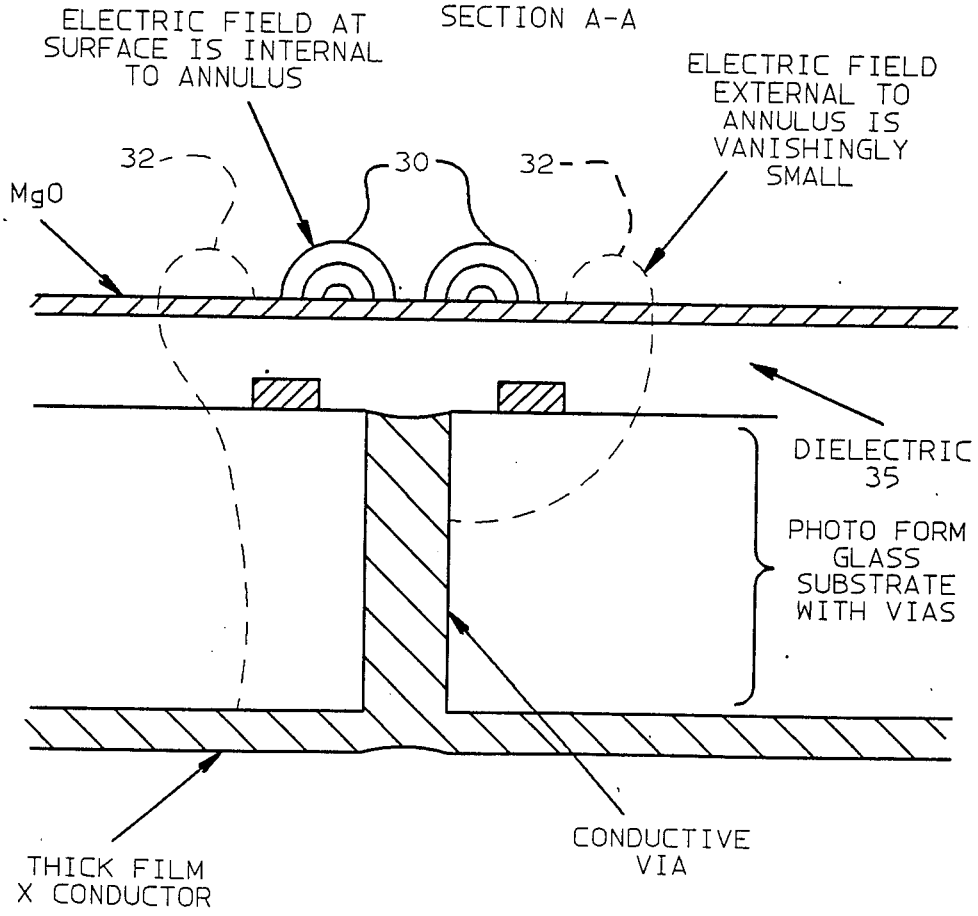

Referrring briefly to FIG. 3(*a*) which illustrates an enlarged display cell, an electric field is developed between via 23 and concentric ring 19 when a write or sustain signal is applied between horizontal and vertical conductors. As graphically illustrated in FIG. 3(*b*), circularly symmetrical primary fields 30 appear on the dielectric surface above each cell. The concentric geometry and thickness of substrate 11 constrains the field to the ring interior. A weaker external field, indicated by the dashed lines 32 of FIG. 3(*b*), is also present, but the long dielectric path through dielectric 35 and substrate 11 lowers the field intensity. Discharges generated by the primary field are also internal to electrode 19, with the plasma boundary essentially coincident with the ring perimeter.

Referring back to FIG. 1, the via holes through the dielectric, in the preferred embodiment of the invention, have a diameter of approximately 5.5 mils. at the front surface of the substrate 11. For a substrate 0.034 inches thick, the holes have an aspect ratio of approximately 7. For production purposes, conventional methods cannot etch such long thin holes. However, the holes can be fabricated by Fotoform* glass, a specially processed glass which can be selectively sensitized to light through an artwork mask during fabrication. Exposed areas etch rapidly relative to unexposed areas, and the differential etch rate make fabrication of thin holes feasible. In addition, the coefficient of thermal expansion of Fotoform is compatible to that of the glass planes, the dielectric and the seal glasses used in the invention.

*Trademark of Corning Glass Co.

The technology of one sided monochrome plasma panel can be extended to color with two changes in panel assembly, use of a faceplate with UV (ultraviolet) sensitive phosphors deposited on the surface confronting the cells, and substitution of a gas mixture which provides intense UV emission lines and low visible intensity.

In an experimental model contructed in accordance with the teachings of the invention, red, green and blue phosphors are deposited on the faceplate in successive horizontal stripes in 35 mil. squares. Each square is surrounded by a black graphite matrix to enhance contrast. A helium-xenon gas mixture is substituted for the neon-argon gas used in conventional monochrome panels. The light output intensity from the color panel is essentially the same as that obtained from the monochrome panel. By separating the phosphor from the cells in this manner, phosphor degradation by positive ion bombardment is prevented, and the discharge surface is protected from contamination by phosphor particulates.

While the invention has been shown and described with reference to preferred embodiments thereof, it will be understood by those skilled in the art that various changes in form and detail may be made therein without departing from the spirit and scope of the invention.

What is claimed is:

1. A single sided a.c. plasma display comprising, in combination, a glass substrate positioned between front and rear cover plates, a first conductor array positioned on the surface of said glass substrate, said first conductor array comprising a plurality of display vias terminating in circular electrodes, a second conductor array positioned coplanar with said first array, said second conductor array comprising a plurality of interconnected annular ring electrodes concentric with said circular electrodes, each pair of said circular and associated annular ring electrodes comprising a display cell, a dielectric coating formed over the surface of said display cells, and means for selectively addressing said display vias and associated annular rings to provide a visible display.

2. A device of the type claimed in claim 1 wherein the thickness of said glass substrate is large relative to that of said dielectric coating to limit the glow spread from selected cells.

3. A device of the character claimed in claim 1 wherein said glass substrate divides said plasma panel into two interconnected chambers.

4. A device of the character claimed in claim 3 wherein said interconnected chambers comprise a front and rear chamber.

5. A device of the character claimed in claim 4 wherein said display vias originate in said rear chamber.

6. A device of the character claim in claim 4 wherein said rear chamber includes a horiontal drive buss to which said display vias are connected.

7. A single sided multicolor a.c. plasma display device comprising in combination a glass substrate positioned between two cover plates, a first conductor array positioned on the surface of said glass substrate, said first conductor array comprising a plurality of display vias terminating in circular electrodes, a second conductor array positioned coplanar with said first array, said second conductor array comprising a plurality of interconnected annular rings concentric with said circular electrodes, each pair of said circular vias and associated annular ring electrodes comprising a display cell, a dielectric coating formed over the surface of said display cells, a plurality of ultra-violet sensitive phosphors deposited on the inner surface of the front cover plate, said display device having a gas mixture therein providing high ultra-violet emission and low visible intensity characteristics, and means for selectively addressing said display vias and associated annular rings to provide a visible display.

8. A device of the character claimed in claim 7 wherein said ultra-violet phosphors deposited on the inner surface of said front cover plate comprise horizontal triads of red, green and blue phosphor dots.

9. A device of the character claimed in claim 7 wherein said gas mixture comprises a mixture of helium and xenon gases.

* * * * *